United States Patent [19]

Beck

[11] 4,151,849

[45] May 1, 1979

[54] ROTATABLE REFILLABLE TOBACCO PIPE

[76] Inventor: Martin E. Beck, 1006 Grand NE., Albuquerque, N. Mex. 87112

[21] Appl. No.: 844,173

[22] Filed: Oct. 21, 1977

[51] Int. Cl.[2] ..... A24F 1/26

[52] U.S. Cl. ..... 131/180; 131/214

[58] Field of Search ..... 131/180, 181, 214, 222, 131/221, 226

[56] References Cited

U.S. PATENT DOCUMENTS

| | | | |
|---|---|---|---|
| 1,302,047 | 4/1919 | Hurst | 131/180 |
| 2,035,783 | 3/1936 | Bernard | 131/180 |
| 2,383,968 | 9/1945 | Hilpert | 131/214 |
| 2,778,363 | 1/1957 | Anderson | 131/181 |

*Primary Examiner*—Stephen C. Pellegrino
*Attorney, Agent, or Firm*—Walter R. Keller

[57] ABSTRACT

In a tobacco pipe, a tobacco storage chamber is integrally formed as a part of what otherwise would be the pipe stem, and the bowl is rotatably attached to the tobacco chamber so that to refill the empty bowl, the bowl is rotated from its normal position to a position where it faces the tobacco chamber; the bowl is refilled by tapping the chamber or the entire pipe, and then being rotated back to its normal position. Attachment of the bowl to the tobacco chambers is accomplished by means of a bail wire passing through eyelits on the tobacco chamber and hooking over ears on the bowl.

3 Claims, 4 Drawing Figures

ROTATABLE REFILLABLE TOBACCO PIPE

BACKGROUND OF THE INVENTION

1. Field of the Invention

This invention relates to tobacco smoking pipes.

2. Description of the Prior Art

In the prior art, tobacco smoking pipes have usually had the bowl and the pipe stem integrally formed together, and it is not unusual for the pipe stem to be segmented in order to part the pipe stem for cleaning and the insertion of a filter. Other pipe designs such as HILPERT, U.S. Pat. No. 2,383,968 and BERNARD, U.S. Pat. No. 2,156,171 have disclosed tobacco smoking pipes with detachable bowls; in addition BERNARD, U.S. Pat. No. 2,156,171 and BERNARD U.S. Pat. No. 2,035,783 disclose tobacco pipes with a chamber for storage of tobacco. However, all prior art utilize a plunger as in Austin U.S. Pat. No. 1,005,005 or feed screws as in ROBERTSON, U.S. Pat. No. 2,402,914, to feed tobacco from the storage chamber to the bowl. In addition, pipes have been designed with multiple bowls as in HURST U.S. Pat. No. 1,302,047 and IVORY U.S. Pat. No. 1,336,233; slidable or detachable bowls such as HILPERT, U.S. Pat. No. 2,383,968 BERNARD, U.S. Pat. No. 2,156,171, BERNARD U.S. Pat. No. 2,035,783; and extendable tobacco chambers as in WARDEN, U.S. Pat. No. 1,055,842. However, none of the prior art discloses a bowl rotatably mounted to the tobacco chamber, wherein the empty bowl can be refilled directly from the tobacco chamber by a mere rotation of the bowl.

SUMMARY

This invention relates to a tobacco pipe having a tobacco chamber with capacity of holding several bowls full of tobacco, and a bowl rotatably fitted to the tobacco chamber. The smoke passes into the tobacco chamber where the smoke is filtered through the stored tobacco before passing from the tobacco chamber into the pipe stem attached thereto. An empty bowl is refilled merely by rotating the bowl toward the tobacco chamber, the pipe or chamber is lightly tapped allowing gravity to force tobacco into the bowl from the chamber until the bowl is full, whereupon the bowl is rotated to its normal smoking position. The aim of this invention is to provide a pipe which itself stores a reasonable amount of tobacco, and the bowl of which is easily refillable, with the tobacco stored in the pipe.

Various additional objectives and advantages will in part be pointed out hereinafter and otherwise become apparent from a consideration of the following description and drawings illustrating an operative embodiment.

DESCRIPTION OF PREFERRED EMBODIMENT

Figure 1:
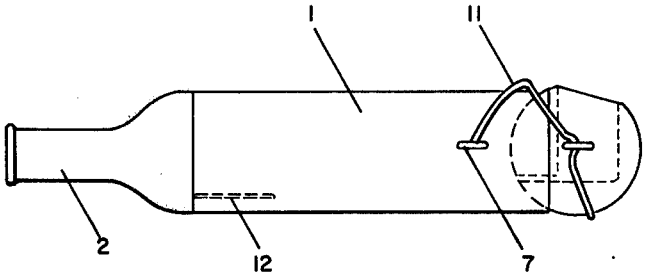
FIG. 1 is a side view of the invention.
Figure 2:
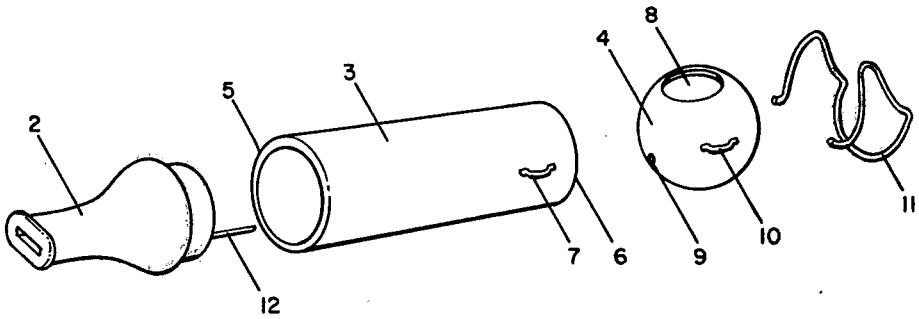
FIG. 2 is an exploded isometric view of the invention.

Referring to the drawings; FIG. 1 and 2 show a tobacco pipe 1 having a short pipe stem 2, a generally cylindrically shaped tobacco chamber 3, and a bowl 4. One end of the tobacco chamber 3 is designated the stem end 5 and receives and snugley fits the pipe stem 2. The other end of the tobacco chamber 3 is designated the bowl end 6. Two eyelets 7 are mounted on the external surface of the tobacco chamber 3; the eyelets 7 are disposed diametrically from each other and are located near the bowl end 6 of the tobacco chamber 3. The bowl 4 is shown as generally spherical in shape, having a fire bowl 8 of generally cylindrical shape inside of the bowl 4. A smoke port 9 is passed from the inside of the fire bowl 8 to the outside of the bowl 4. In the normal burning position, the smoke is drawn from the fire bowl 8 through the smoke port 9 into the tobacco chamber 3. The bowl 4 has two ears 10 diametrically opposed from each other. The bowl 4 is retained to the tobacco chamber 3 by a bail wire 11 which passes through one eyelet 7, hooking onto both the ears 10, then through the other eyelet 7. The bowl-end 6 of the tobacco chamber 3 is shaped in a circle thus allowing bowl 4 to fit rotatably the tobacco chamber 3. After a pipe full of tobacco is smoked, the fire bowl 8 is emptied; and to refill, the bowl 4 is rotated so that the fire bowl 8, faces the interior of the tobacco chamber 3. Tobacco is then tapped in to the fire bowl 8, and the bowl 4 is then rotated back to the normal burning position. It is appreciated that the function of refilling will be optimized if loose tobacco rather than shredded tobacco is used.

In the event the smoke port 9 becomes clogged with tar and residue, it can be cleaned by separating the pipe stem 2 from the tobacco chamber 3; the stem 2 having a pick 12 attached thereto; and inserting the pick 12 into the smoke port 9. It is an obvious extension of this invention that a variety of screens, filters, or flavor tablets holders could be placed in the pipe stem 2 or the tobacco chamber 3, for example a menthol flavored tablet to flavor the taste of the smoke.

Figure 3:
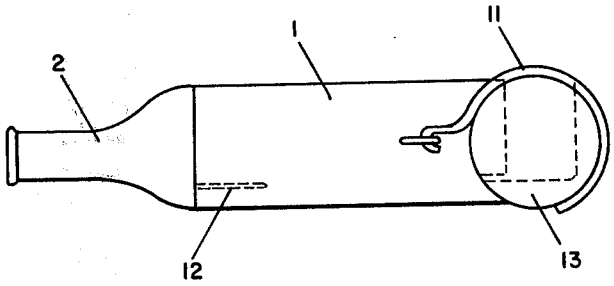
FIG. 3 is a side view of alternate configuration.
Figure 4:
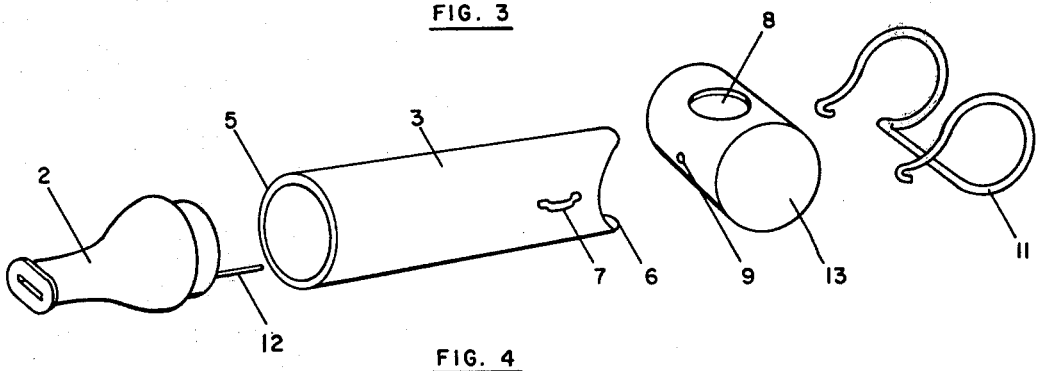
FIG. 4 is an exploded isometric view alternate configuration.

While the preferred embodiment described is spherical bowl 4 and a cylindrical tobacco chamber 3, it is obvious and within the scope of this invention that the same rotatable refillable function could be achieved with a variety of shapes of bowls such as an essentially cylindrical bowl 13 with the axis of the cylinder normal to the axis of the tobacco chamber 3, and the shape of tobacco chamber 3 being irrelevant so long as the bowl end 6 of the tobacco chamber 3 is shaped to fitably accommodate the rotation of the bowl 13 and the bail wire 12 suitably shaped to retain the bowl 13 to the tobacco chamber 3, all as shown in FIG. 3 and 4.

I claim:

1. A tobacco pipe having a stem, tobacco chamber, bowl, and bail wire wherein the improvement comprises:

the pipe stem being of standard construction, and having a pick attached thereto to be stored inside the tobacco chamber;

the tobacco chamber being generally cylindrical in shape having a stem end shaped to snuggly fit the pipe stem, and having a bowl end shaped to rotatably fit the bowl; and having two eyelets diametrically disposed on the external surface of the tobacco chamber near the bowl end;

the bowl being shaped to rotatably fit the bowl end of the tobacco chamber, said bowl having a fire bowl inside the bowl and a smoke port connecting the fire bowl to the outside of the bowl;

the bail wire which passes through the eyelets on the tobacco chamber and hooks over the ears on the bowl thereby rotatably retaining the bowl to the tobacco chamber; wherein the bowl can be rotated so that the fire bowl faces the tobacco chamber for refilling the fire bowl from the tobacco chamber.

2. The tobacco pipe in claim 1 wherein the bowl is generally spherical, and the bowl end of the tobacco chamber is circularly shaped so that the bowl rotatably fits the tobacco chamber.

3. The tobacco pipe in claim 1 wherein the bowl is generally cylindrical in shape with the axis of the bowl being normal to the axis of the tobacco chamber, and the bowl end of the tobacco chamber being shaped so that the bowl rotatably fits the tobacco chamber.

* * * * *